US006340927B1

(12) United States Patent
Peschl

(10) Patent No.: US 6,340,927 B1
(45) Date of Patent: Jan. 22, 2002

(54) HIGH THERMAL EFFICIENCY POWER RESISTOR

(75) Inventor: Hans Peter Peschl, Pachernweg (AT)

(73) Assignee: Elektronische Bauelemente Gesellschaft m.b.H, Pachernweg (AT)

( * ) Notice: Subject to any disclaimer, the term of this patent is extended or adjusted under 35 U.S.C. 154(b) by 0 days.

(21) Appl. No.: 09/896,631

(22) Filed: Jun. 29, 2001

(51) Int. Cl.[7] ..... H01C 1/08

(52) U.S. Cl. ..... 338/59; 338/20; 338/204; 338/332

(58) Field of Search ..... 338/20, 51, 53, 338/54, 322, 331, 332, 204, 219, 59

(56) References Cited

U.S. PATENT DOCUMENTS

| | | | | |
|---|---|---|---|---|
| 1,734,235 A | * | 11/1929 | Slepian | 338/204 |
| 2,518,941 A | * | 8/1950 | Satchwell et al. | 338/59 |
| 2,550,169 A | * | 4/1951 | Sokoloff | 338/219 |
| 3,467,937 A | * | 9/1969 | Norton | 338/204 |
| 3,649,944 A | * | 3/1972 | Caddock | 338/260 |
| 4,746,895 A | * | 5/1988 | Kato et al. | 338/272 |

FOREIGN PATENT DOCUMENTS

| | | |
|---|---|---|
| DE | 39 33 956 C2 | 11/1989 |
| DE | 43 43 149 C2 | 12/1993 |

* cited by examiner

*Primary Examiner*—Karl D. Easthom
(74) *Attorney, Agent, or Firm*—Coats & Bennett, P.LLC

(57) ABSTRACT

A power resistor may be formed as a stacked arrangement of first and second terminal plates positioned on either side of a resistor plate and insulated therefrom by interposing first and second insulator plates. Preferably, the insulator plates are metallic plates with non-conductive surfaces. As an example, anodized aluminum plates may be used. The metallic insulator plates provide good thermal conduction paths between the resistor plate and the opposing terminal plates, allowing efficient heat transfer from the power resistor. Further, with metallic insulators, each layer in the stack may be made of metal with attendant structural advantages. For example, the stacked resistor may be subjected to significant compressive force in mounting without need for special precautions or load distribution measures, as might be required with ceramic insulating layers. Preferably, the stack includes interlayer features allowing it to be frictionally fitted together, thus simplifying assembly.

21 Claims, 5 Drawing Sheets

HIGH THERMAL EFFICIENCY POWER RESISTOR

BACKGROUND OF THE INVENTION

The present invention generally relates to electrical resistors, and particularly relates to power resistor applications.

Power resistors find broad application across a variety of system types and applications. In many electric motor applications, power resistors are used as braking loads for the motors. In other applications, such as in frequency converters, power resistors are used in snubber circuits that protect high-power switching devices by suppressing voltage and current spikes arising from line switching actions.

While these and other applications differ significantly in terms of end purpose, many of the design and operating challenges imposed on power resistors are common across the range of uses. Power resistors must generally provide reliable, safe, long term operation under rated power conditions, which often entails extended operation at high power levels. Because the dissipation of electrical energy through resistance involves converting electrical energy to thermal energy, power resistor reliability depends on good thermal management.

Often, power resistors are required to dissipate so much electrical power that the resultant heat would be damaging absent some form of heat sinking. Heat sinking entails placing a heat-generating object in thermal contact with a heat-dissipating object. In practical terms, for power resistors, this often entails placing the power resistor in good thermal contact with a larger heat radiator, or even in contact with a liquid cooled heat sink.

In whatever configuration successful thermal management depends on the efficient conduction of heat away from the power resistor and into the heat sink. Without good thermal conduction, operating temperature of the power resistor may rise to dangerous and damaging levels, which is unacceptable in any practical system.

Many techniques exist for enhancing the thermal performance of power resistors. First, the resistors themselves may be made to have good intrinsic heat dissipation characteristics. Imbuing such characteristics conventionally entails making the resistor larger, which has obvious disadvantages in size-constrained systems. This is exacerbated by the tendency to use banks of power resistors, rather than just one or two such devices in a given system.

Other approaches focus on establishing a thermal conduction path between each power resistor and the heat sink. Maintaining good heat flow requires minimizing thermal resistance at the junction between the power resistor and the heat sink. Techniques for accomplishing this minimization include the use of thermal bonding compounds, along with mating the power resistor to the heat sink under relatively high contact pressure. Inherent in these approaches is the notion of providing generally smooth, flat mating surfaces between resistor and heat sink.

Arguably, too many tradeoffs arise from the above considerations. Installation considerations limit the size and therefore intrinsic heat dissipation capability of power resistors, which imposes the requirement to efficiently conduct heat out of the power resistor into a heat sink. Thus, power resistor package must comprise materials that provide good thermal conduction, yet the need to minimize thermal contact resistance requires relatively high contact pressure requirements. The resultant mechanical stresses suggest the need for mechanically robust power resistor packages, but this must be balanced against the thermal properties of the materials used.

Thus, a power resistor that embodies good thermal conduction, mechanical robustness, and small size is needed. Preferably, this power resistor would be relatively simple to manufacture, and would accommodate various mounting arrangements. The present invention addresses these and other needs, as will be made evident later herein.

BRIEF SUMMARY OF THE INVENTION

A power resistor includes features that enhance its performance in high-power electrical systems, and may be formed in a stacked arrangement with opposing terminal plates. Generally, the power resistor includes two terminals for contacting with an external system, and a resistor element providing the desired electrical resistance between the two terminals. Preferably, an electrical insulator is positioned between each terminal and the resistor element to prevent electrical shorting between the two terminals across the resistor element. By using electrical insulators with favorable thermal conduction characteristics, the insulators provide efficient thermal conduction paths from the resistor element into the two terminals, one or both of which may be in contact with an external heat sink.

In some embodiments, the insulators are made from aluminum or other metal to capitalize on the good thermal conduction and mechanical strength of metal. A surface treatment, such as an anodization process for aluminum, is used to render the metallic insulator's surface nonconductive. The use of treated metal as electrical insulation within a power resistor structure provides the power resistor the ability to withstand compressive mounting forces without need for special precautions, as well as providing good thermal conduction between the resistor element and the terminals.

When implemented in a stacked arrangement, the component pieces comprising the power resistor are preferably joined by mechanically pressing them together. An exemplary stack includes top and bottom terminals with a resistor element positioned between them, and with an insulator positioned between each terminal and the resistor element. The different elements within the stack include mechanical features that establish the desired electrical contact points between the two terminals and the resistor element, and that further provide the inter-element contacts that join the stack when mechanically pressed together.

In an exemplary stack arrangement, the terminals, insulators, and the resistor are all substantially flat plates or discs that stack together. In this arrangement, the top or first terminal has a raised projection on its inner surface that is preferably centrally located. The insulator disposed between this first terminal and the resistor element has a central cutout or opening that exposes the resistor element. The terminal's projection passes through the opening, making mechanical and electrical contact with the resistor element. The resistor element may include a opening corresponding to the shape of the terminal's projection and sized to allow the resistor element to be pressed onto the projection, thus fixing the resistor element to the top terminal, with the intervening insulator sandwiched between them.

Similarly, the bottom or second terminal has a perimeter lip formed on its inner surface, with the lip defining an inset area or recess. The second insulator is sized to fit into this recess and is positioned therein. In turn, the resistor element is sized such that its outer perimeter conforms to the terminal's perimeter lip, and just matches or is slightly larger in size than the inset area. Thus, the resistor element may be joined to the second terminal by pressing it into the inset area. In this manner, only the outer perimeter of resistor element is in electrical contact with the second terminal.

When implemented in the above stacking arrangement, the power resistor comprises a small, mechanically robust package that is well suited for high power applications. The power resistor is well suited for continuous power dissipation, and for operation subject to high power level transient voltage spikes. Its use of thermally efficient electrical insulators to draw heat from the resistor element into the two terminals allows the power resistor to dissipate very high levels of electrical power, provided proper heat sinking measures are taken. The preferably flat and outwardly smooth terminals complement heat-sinking arrangements by providing relatively large, low thermal-resistance surface areas for contacting the power resistor.

DETAILED DESCRIPTION OF THE INVENTION

Figure 1:
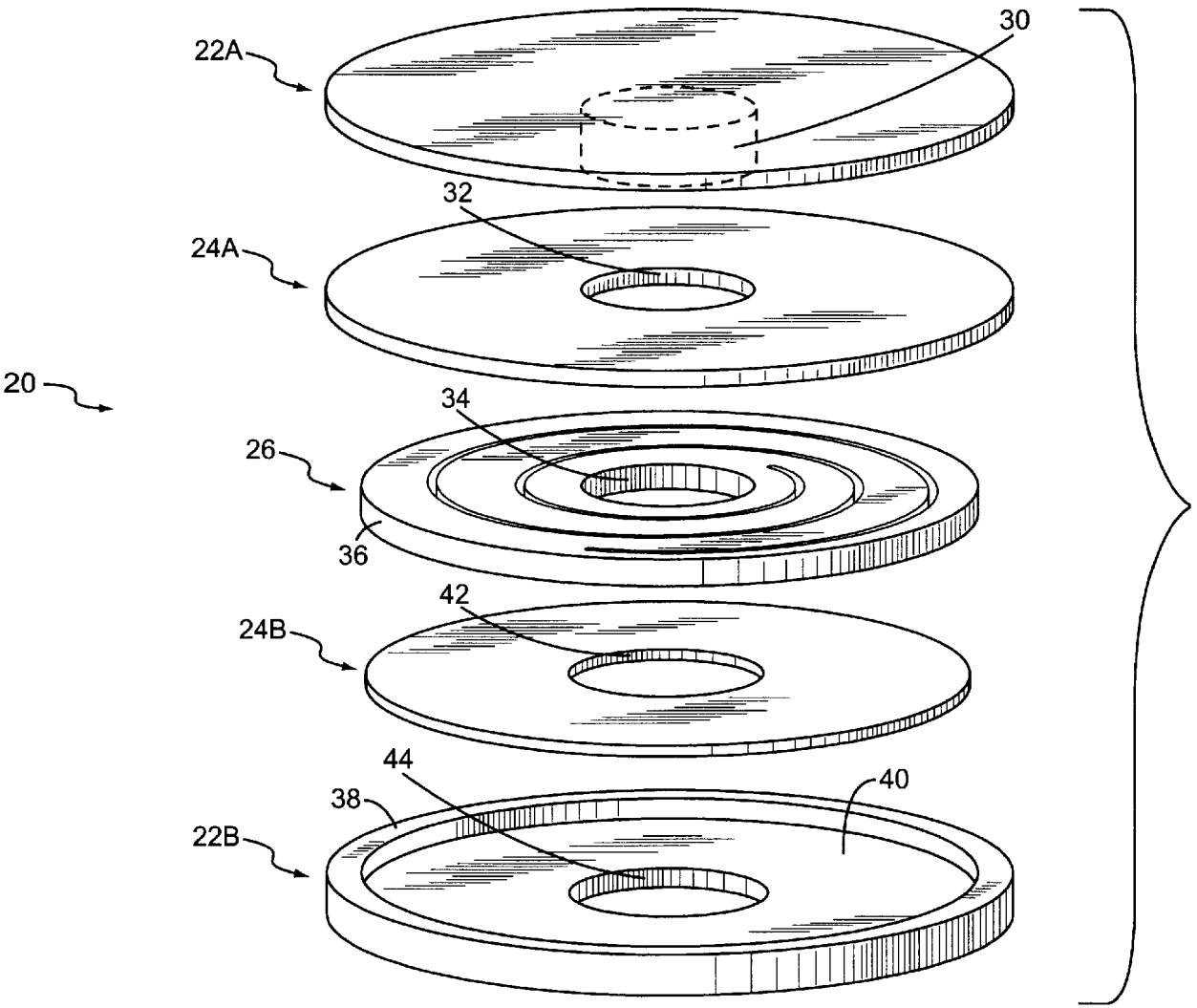
FIG. 1 is an exploded view of an exemplary power resistor in accordance with the present invention.

FIG. 1 illustrates an exemplary configuration for the power resistor of the present invention. In this embodiment, a power resistor 20 comprises top and bottom terminals 22A and 22B, top and bottom electrical insulating elements 24A and 24B, and a resistor element 26. Order of stacking comprises terminal-insulator-resistor-insulator-terminal. When stacked together, the elements comprising the power resistor 20 define an electrical path from the terminal 22A to the terminal 22B through the resistor 26.

As will be detailed later, the power resistor stack preferably uses mechanical interference between the top and bottom terminals 22A and 22B and the resistor 26 for fastening. That is, the stack elements are aligned and then mechanically pressed together. After such pressing, an optional high current pulse may be used to effectively weld the resistor 26 to the respective terminals 22A and 22B.

Terminals 22A and 22B preferably comprise metallic conductors formed as plates or discs with smooth, flat outer surfaces. Copper represents an exemplary terminal material because of its low electrical and thermal resistances. As with any thermal conduction application, maximizing the surface area at heat transfer interfaces reduces thermal resistance. Thus, the flat outer surfaces of the terminals 22A and 22B provide essentially ideal contact surfaces for external mounting arrangements and heat sinks. However, in some applications, advantage may be gained by forming or attaching some type of mounting or fastening feature on the exterior of one or both terminals 22A and 22B. Such variations are reasonably understood to apply to any device that may be used in a broad range of applications.

The resistor element 26 defines the electrical resistance seen by current flowing through the power resistor 20. As with the terminals 22A and 22B, the resistor 26 is preferably formed as a metal plate or disc, with its specific geometry normally chosen to complement that of the terminals. A range of metals or alloys thereof may be selected for forming the resistor 26. Generally, a balance between desired operating temperature, thermal expansion characteristics, and specific resistance determines material selection. Later discussion provides more particular structural details for the resistor 26, and makes clear how a desired current path is established between the terminals 22A and 22B through the resistor 26.

By internally separating the terminals 22A and 22B from the resistor 26, the insulators 24A and 24B also help establish the desired electrical path. Simply, the insulators 24A and 24B are non-conductive elements interposed between the resistor 26 and respective terminals 22A and 22B. Metal represents an ideal material selection for the insulators but for its electrical conductivity. That is, metal generally provides good thermal conduction, and responds well to mechanical strain. This last characteristic is particularly beneficial as power resistors are often mounted to heat sinks under large compressive force to maximize heat transfer from the power resistor. Such forces can typically range as high as 60,000 Newtons (N).

Rendering the metallic material used for the insulators 24A and 24B non-conductive may involve one or more approaches. Certain surface coatings or jackets might be applied to the base metal to render its surface non-conductive. However, any approach adopted should not seriously degrade heat resistance, thermal conduction, and mechanical suitability. With aluminum as the base metal, the insulators 24A and 24B may be anodized, in which a hard, non-conductive and continuous layer of aluminum oxide is formed on the aluminum's outer surface.

Anodization may rely on the ELOXAL process, which is well documented in the art. With ELOXAL treatment, a microcrystalline layer of Aluminum Oxide (e.g., $Al_2O_3$) forms on the surface of the aluminum work piece. As is known, with proper control of the ELOXAL process parameters, the aluminum oxide may be formed in a continuous, uniform layer over the work piece's surface at a thickness in excess of 25 um. At the expense of additional process time, the layer thickness may be increased to 40 um or more, although such thickness is typically not necessary.

Anodized aluminum satisfies the requirement of being electrically non-conductive while still having excellent thermal conduction properties. For reference, base aluminum has a characteristic thermal conductivity in the range of 195 Watts per Kelvin•meter (W/Km). Typical electrically insulative plastic materials have thermal conductivities ranging from 0.6 to 3.5 W/Km. In contrast, $Al_2O_3$ at roughly 96% purity has a thermal conductivity in the range of 26 W/Km, which is significantly better than typical plastic insulators. Ceramic (e.g., Aluminum Nitride or AIN) offers excellent thermal conduction, having a thermal conductivity in the range of 110 to 180 W/Km. However, ceramic is relatively expensive, and its fragility leaves it ill suited for the high mechanical stresses power resistors are often subjected to without special precautions in mounting or in resistor construction.

Anodized aluminum also has a surface hardness that complements its use in the power resistor stacking arrangement. As the various stack elements likely comprise different materials (e.g., different metals), different layers of the stack might be expected to have differing thermal expansion characteristics. Thus, the resistor 26, terminals 22A and 22B, and insulators 24A and 24B may all expand or contract to a greater or lesser extent relative to each other as the power resistor 20 heats and cools. Differences in expansion may cause some movement between stack layers, so providing the insulators 24A and 24B with a hard surface layer helps maintain the integrity of the nonconductive insulator surfaces over the operating life of the power resistor 20.

As noted above, the interposition of insulators 24A and 24B restricts electrical contact between the resistor 26 and respective terminals 22A and 22B to desired contact points or areas. The restriction of electrical contact with the terminals combined with the design of the resistor 26 defines the electrical path through the power resistor 20.

To establish this path, a preferably cylindrical projection 30 on the inner surface of terminal 22A projects downward through a central opening 32 of the insulator 24A to make contact with the resistor 26. Preferably, the resistor 26 includes a central opening 34 that allows it to be pressed onto the projection 30. Thus, the projection 30 projects into and engages with the opening 34.

This engagement between the projection 30 and the inner surface of the opening 34 provides electrical and mechanical contact between the terminal 22A and the resistor 26. Preferably, the opening 32 in the insulator 24A is slightly larger than the diameter of the projection 30, whereas the diameter of the opening 34 in resistor 26 is slightly smaller than the diameter of the projection 30. As the height of the projection 30 at least preferably equals the combined thickness of insulator 24A and resistor 26, this sizing of the openings allows the resistor 26 to be seated onto the projection 30 by a mechanical press, with the insulator 24A positioned between it and the terminal 22A.

With electrical contact between the terminal 22A and the resistor 26 thus made, allowing the resistor 26 to contact the bottom terminal 22B along a perimeter contact area 36 completes the electrical path through the power resistor 20. The terminal 22B has a perimeter lip 38, here a circumferential lip or ridge, which defines an interior inset region 40. The depth of the inset region 40 is preferably sufficient to receive the combined height of the insulator 22B stacked together with the resistor 26. As such, the outer diameter of the insulator 24B is made slightly smaller than the inner diameter of the perimeter lip 38, such that the insulator 24B drops into the inset area 40.

In contrast, the outer diameter of the resistor 26 is generally made equal to or slightly larger than the inner diameter of the perimeter lip 38, such that there is a defined amount of mechanical interference between the resistor 26 and the terminal 22B as the resistor 26 is pressed into the inset area 40 of the terminal 22B. This allows the resistor 26 to be securely joined with the terminal 22B by mechanically pressing it into the inset area 40.

With the designed-in mechanical interference between the terminals 22A and 22B and the resistor 26, the component parts of the stack may be frictionally fitted together by mechanical press. One might place the insulator 24B into the inset area 40 of terminal 22B, and then press the resistor 26 into place. This subassembly might then be fitted onto the central projection 30 of the terminal 22A and pressed into place, with the insulator 24A placed on the terminal 22A before attaching the subassembly. Preferably, however, the elements comprising the power resistor 20 are aligned in their proper stack order, and pressed together in one operation.

Figure 2:
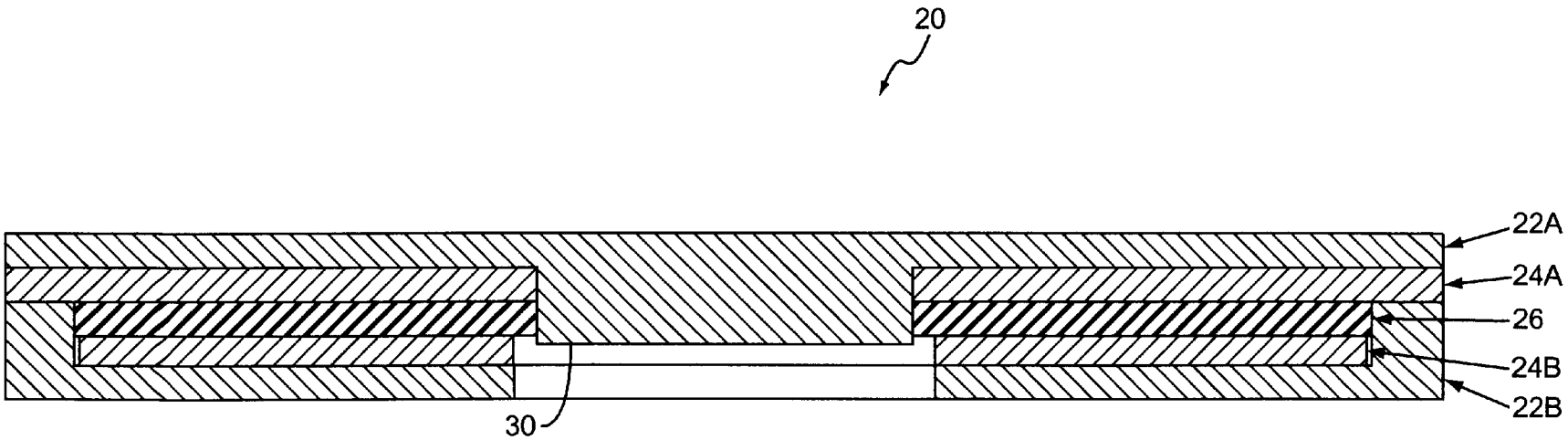
FIG. 2 is a cross-sectional view of the power resistor detailed in FIG. 1.

FIG. 2 is a cross-sectional diagram of the power resistor stack 20. The use of insulators 24A and 24B in restricting electrical contact between the resistor 26 and the top and bottom terminals 22A and 22B is more clearly shown in this cross-sectional view. Note that the height of the projection 30 may vary, although it should terminate before extending through the plane of the bottom terminal 22B.

Current may flow through the power resistor 20 in either direction, but for purposes of discussion current is assumed to enter the top of the power resistor 20. Electrical current flows into the top terminal 22A and into the resistor 26 via contact between the projection 30 and inner surface of opening 34 in the resistor 26. Current then flows outward through the resistor 26 in a path defined by the cut pattern of the resistor 26. This cut pattern is discussed more clearly later herein. Contact between the outer circumference of the resistor 26 and the inner wall of the lip 38 formed in the bottom terminal 22B allows the current to flow into the terminal 22B and on into exterior devices or systems.

One or more elements within the stack comprising the power resistor 20 may take on other geometries. For example, the stack may comprise rectangular plates. This configuration may have advantages for arrays of power resistors 20. As the overall geometry of the stack elements may change, so too may the geometry of the interior features of the stack that permit mechanical joining. Thus, the terminal 22A may have one or more non-cylindrical projections 30 for contacting and fastening to the resistor 26. Similarly, the perimeter lip 38 of the terminal 22B may be changed or altered as needed to conform to the overall geometry of the terminal.

Figure 3A:
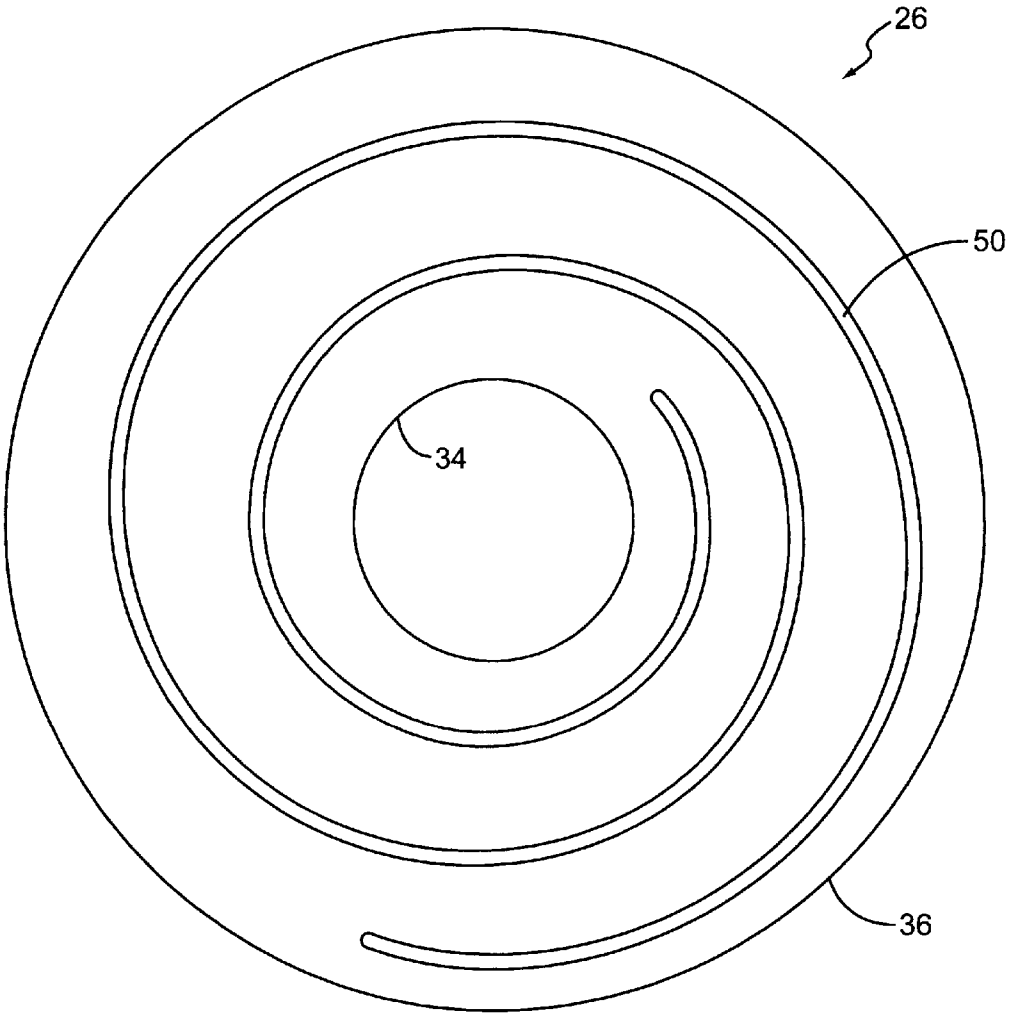
FIG. 3A is a diagram of an exemplary configuration for the resistor element of FIG. 1.

FIG. 3A illustrates an exemplary embodiment for the resistor 26. Preferably the resistor is a metallic disc or plate having the inner and outer contact areas or points 34 and 36 earlier discussed.

One or more cut lines 50 determine the electrical path between contact areas 34 and 36 of the resistor 26. These cut lines 50 may be etched, machined, laser cut, or formed by any other suitable process. In the illustration, cut lines 50 comprise a single continuous spiral cut made from the inner region of the resistor 26 continuing on in a spiral pattern to its outer area. This defines a conduction path of a desired length. This length, along with the specific resistance of the material from which the resistor is formed determines the electrical resistance of the power resistor 20, ignoring any contact resistances.

Figure 3B:
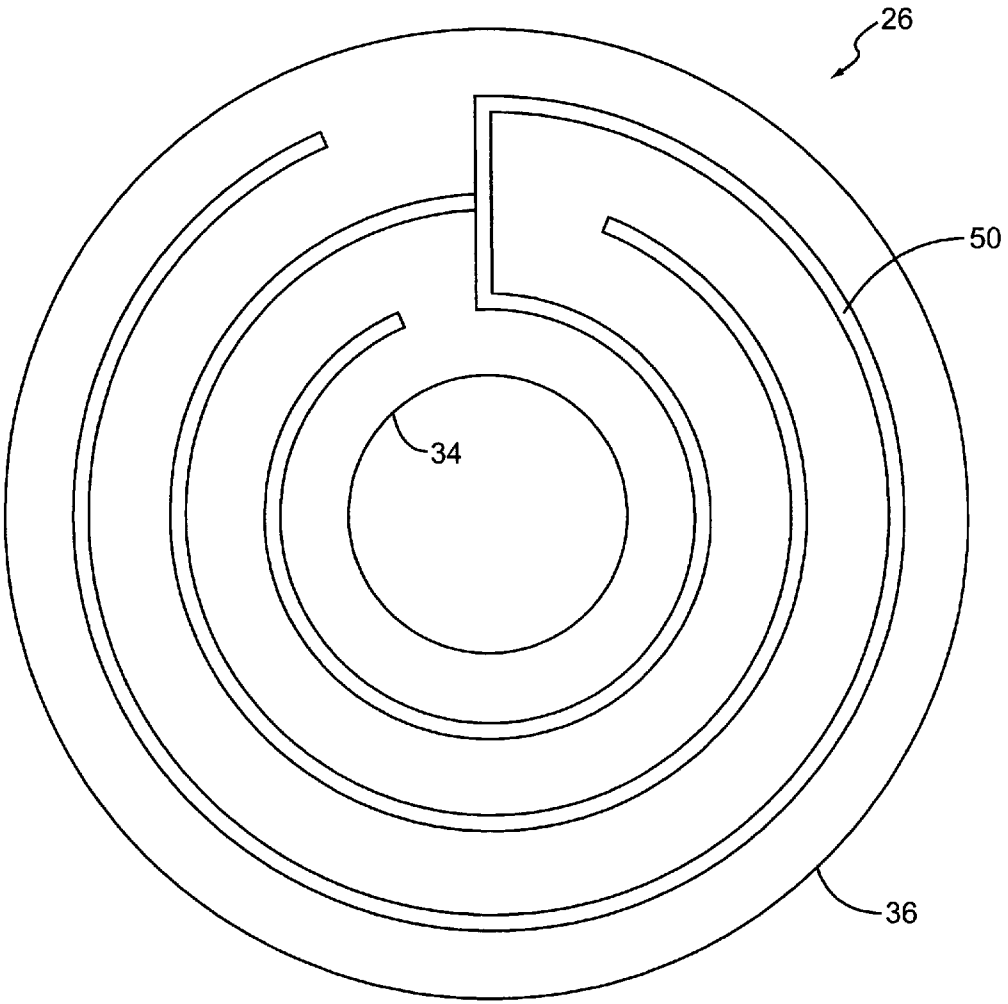
FIG. 3B is a diagram of an exemplary alternate configuration for the resistor element of FIG. 1.

FIG. 3B depicts an alternate exemplary configuration for the resistor 26. In some applications, the electrical system in which the power resistor 20 is used may be sensitive to inductance. In such instances, it may be desirable to configure the resistor 26 to have as low an inductance as possible. Thus, the cut lines 50 may be varied or altered to minimize or eliminate inductance in the current path between the contact areas 34 and 36.

A power resistor 20 formed in accordance with the above exemplary details provides axial current and heat flow, which may simplify mounting within an electrical system, and complements compressive mounting against a heat sink. Here, axial heat flow denotes a general heat flow direction that is normal to the plane of the insulators 24A and 24B.

Figure 4A:
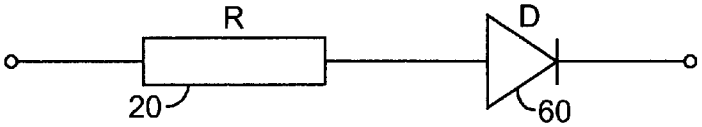
FIG. 4A is a diagram of an exemplary circuit application for the power resistor of FIG. 1.

FIG. 4A is a simplified diagram of a typical circuit in which the power resistor 20 might be used. The circuit comprises the power resistor 20 electrically connected in series with a high-power semiconductor device 60, which may, for example, be a diode. This type of arrangement finds common application in a variety of circuits, such as in some types of charging and discharging applications. For example, the power resistor 20 might serve to limit inrush current into a capacitor bank (not shown) during charging, while the semiconductor 60 may act to block reverse current from the capacitor bank, or serve some switching function. In operation, then, the power resistor 20 and the semiconductor 60 may generate significant heat, depending upon the magnitude and frequency of the current pulses passing through them.

Figure 4B:
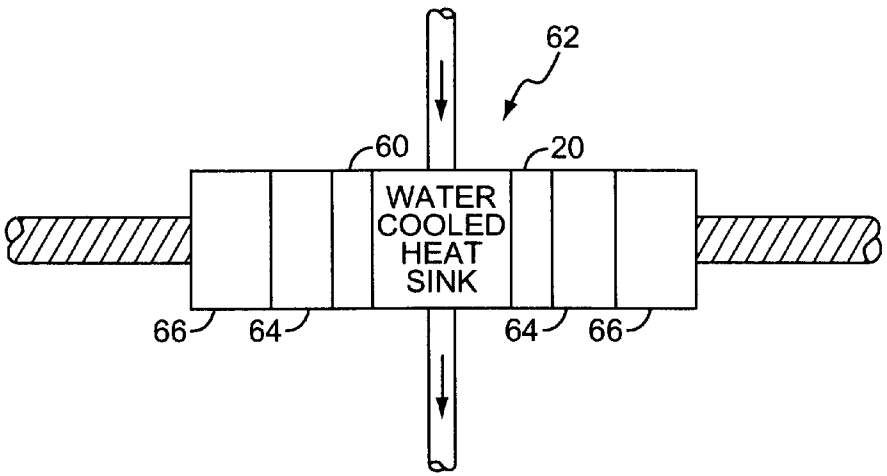
FIG. 4B is a diagram of a mechanical arrangement for heat sinking the circuit of FIG. 4A.

An exemplary mechanical for heat sinking the circuit of FIG. 4A is illustrated in FIG. 4B. It should be noted that the illustrated arrangement is simply one of many possible physical arrangements for using the power resistor 20 in practical applications.

As shown, the power resistor 20 and the semiconductor 60 are pressed against opposing sides of a water-cooled heat sink 62. Cooling fluid, which may or may not be water circulates through the heat sink 62 and serves to conduct heat away from the power resistor 20 and semiconductor 60. Pressure plates 64 interface the semiconductor 60 and the power resistor 20 to opposing screw clamps 66, which may be tightened to achieve the desired compression for efficient heat sinking.

In exemplary embodiments, the material selection and structure of the power resistor 20 allows it to achieve heat dissipation performance better than 500 Watts per square inch (500 W/in$^2$), and voltage withstand capabilities greater than one kilo-volt (1 KV). As such, the exemplary power resistor 20 provides a comparatively small package capable of operating under high voltages and demanding thermal conditions.

Variations of the present invention may be practiced without departing from its scope and intent. Details in the above discussion and accompanying illustrations are exemplary and should not be construed as limiting. Indeed, the present invention is limited only by the following claims and their reasonable equivalents.

What is claimed is:

1. A power resistor comprising:

first and second terminals;

a resistor positioned between the first and second terminals;

a first electrical insulator positioned between said resistor and said first terminal, and a second insulator positioned between said resistor and said second terminal;

said first terminal including an inner surface facing said first electrical insulator;

said inner surface of said first terminal having a projection extending through an opening formed in said first insulator and contacting said resistor;

said second terminal including an inner surface facing said second insulator; and said inner surface of said second terminal having a perimeter lip operative to contact a perimeter portion of said resistor.

2. The power resistor of claim 1 wherein the projection extending from the inner face of the first terminal is generally centrally located on the inner surface of said first terminal, and wherein there is provided a generally central opening in the resistor through which said projection contacts said resistor.

3. The power resistor of claim 2 wherein the projection extends into the opening formed in the resistor in such a manner that a frictional fit is achieved, thereby electrically and mechanically connecting the first terminal with the resistor.

4. The power resistor of claim 1 wherein the opening formed in said first insulator is slightly larger than the projection associated with the first terminal such that the projection can extend through the opening in said insulator and contact the resistor.

5. The power resistor of claim 1 wherein said inner face of said second terminal comprises an inset area defined by said perimeter lip and wherein said resistor is sized to fit in the inset area.

6. The power resistor of claim 1 wherein the second insulator is disposed within said inset area and wherein the resistor is frictionally fitted within the perimeter lip of the second terminal.

7. The power resistor of claim 1 wherein the resistor and insulators are disc-shaped.

8. The power resistor of claim 1 wherein said resistor comprises a generally flat metallic member with one or more interior cuts defining an electrical conduction path from a central area of said resistor to a perimeter area of said resistor.

9. The power resistor of claim 8 wherein said conduction path comprises a generally spiral path that extends from the central area to the perimeter area of the resistor.

10. The power resistor of claim 8 wherein said conduction path comprises a low inductance conduction path that extends between the central area of said resistor and the perimeter area of said resistor.

11. The power resistor of claim 1 wherein at least one of said insulators comprises a metal plate having an electrically non-conductive surface.

12. The power resistor of claim 11 wherein the insulator comprises an aluminum plate having an aluminum oxide surface.

13. A power resistor comprising: a resistive element; at least one terminal electrically connected to the resistive element; and an insulator disposed between said resistive element and said terminal; and wherein said insulator comprises an aluminum plate having a non-conductive oxide surface.

14. The power resistor of claim 13 wherein said insulator acts to electrically insulate said terminal from said resistive element and to transfer heat from said resistive element to said terminal.

15. The power resistor of claim 13 wherein the resistive element comprises a disc resistor, and wherein said insulator is sandwiched between the disc resistor and the terminal.

16. The power resistor of claim 13 including a pair of terminals and a pair of insulators, and wherein the pair of insulators are disposed on opposite sides of the resistive element while the pair of insulators and the resistive element are disposed between the two terminals; and wherein each terminal is electrically connected to the resistive element.

17. The power resistor of claim 16 wherein each of said insulators transfers heat from the resistive element outwardly to an adjacent terminal.

18. The power resistor of claim 16 wherein one terminal includes a projection that projects into and engages with an opening formed in the resistive element and the other terminal includes a lip for surrounding and engaging an edge of the resistive element.

19. The power resistor of claim 18 wherein both terminals are structurally connected to the resistive element.

20. The power resistor of claim 16 wherein the terminals, insulators, and resistive element are stacked.

21. The power resistor of claim 16 wherein each insulator includes a pair of surfaces with one surface engaged with the resistive element and the other surface engaged with an adjacent terminal, and wherein each insulator insulates an adjacent terminal from the resistive element and transfers heat from the resistive element to the adjacent terminal.

* * * * *